US007806840B2

(12) United States Patent
Chen

(10) Patent No.: US 7,806,840 B2
(45) Date of Patent: Oct. 5, 2010

(54) MASSAGE DEVICE FOR RUBBING, BEATING AND KNEADING

(76) Inventor: Ko-Po Chen, No 36, 12$^{th}$ Rd, Ta-Li Industrial District, Tai-Li City, Taichung (TW)

( * ) Notice: Subject to any disclaimer, the term of this patent is extended or adjusted under 35 U.S.C. 154(b) by 970 days.

(21) Appl. No.: 11/606,842

(22) Filed: Nov. 28, 2006

(65) Prior Publication Data

US 2008/0125683 A1 May 29, 2008

(51) Int. Cl.
*A61H 15/00* (2006.01)

(52) U.S. Cl. ..... 601/99; 601/102; 601/103; 601/116

(58) Field of Classification Search ..... 601/90, 601/93, 94, 98–103, 115, 116
See application file for complete search history.

(56) References Cited

U.S. PATENT DOCUMENTS 6,629,939 B2 * 10/2003 Jikiba et al. ..... 601/99
7,029,453 B2 * 4/2006 Chen ..... 601/99
7,083,582 B2 * 8/2006 Chen ..... 601/99
2005/0096571 A1 * 5/2005 Miki ..... 601/99
2007/0167887 A1 * 7/2007 Tsukada et al. ..... 601/97
2008/0009777 A1 * 1/2008 Chiu ..... 601/99
2009/0124940 A1 * 5/2009 Nishio et al. ..... 601/49
2009/0177128 A1 * 7/2009 Fukuyama et al. ..... 601/98

* cited by examiner

*Primary Examiner*—Danton DeMille
(74) *Attorney, Agent, or Firm*—W. Wayne Liauh

(57) ABSTRACT

Provided is a motor driven massage device comprising a rubbing mechanism comprising two eccentric rubbing sleeves at both ends of a motor shaft, two housings each for enclosing the rubbing sleeve, and two pairs of upper and lower arms each arm having an extended roller; a beating mechanism comprising two beating sleeves at both ends of a motor shaft, and two links each interconnected the beating sleeve and the housing; an angle adjustment mechanism comprising a rotating rod and a gear based linking assembly interconnected the rotating rod and the rubbing mechanism for adjusting an angle of each roller; and two kneading mechanisms at both sides each disposed proximate the housing and the lower arm and comprising two spaced plates and a drive source between the plates for activating the lower arms.

6 Claims, 11 Drawing Sheets

MASSAGE DEVICE FOR RUBBING, BEATING AND KNEADING

BACKGROUND OF THE INVENTION

1. Field of Invention

The present invention relates to massage devices and more particularly to such a massage device with improved characteristics.

2. Related Art

A conventional massage device is shown in FIGS. 1 to 3. The device comprises a rubbing mechanism 1, a beating mechanism 2, and a transmission mechanism 3. The rubbing mechanism 1 comprises a transverse shaft 11 having two opposite elongate slots 111, two side rubbing sleeves 12 each having a sliding member 121 disposed in the slot 111, the rubbing sleeve 12 being configured as an eccentric one, two arms 13 each extended forwardly from the rubbing sleeve 12, and two pairs of rollers 14 each at a forward end of the arm 13.

The beating mechanism 2 comprises a transverse shaft 21 including two opposite elongate slots 211, two side rubbing sleeves 22 each having a sliding member 221 disposed in the slot 211, the rubbing sleeve 22 being configured as an eccentric one, and two links 23 each interconnected the rubbing sleeve 22 and the arm 13. The transmission mechanism 3 comprises a central motor 31, an elongate joint 32 rotatably connected to a driving shaft of the motor 31, two first links 33 each rotatably connected to either end of the joint 32, two second links 34 each having its intermediate portion pivotably connected to an outer end of the first link 33, the second links 34 being substantially perpendicular to the first links 33, and two pulleys 35 each having one end connected to a forward end of the second link 34 and the other end connected to both the shafts 11 and 21.

By configuring as above, the rubbing sleeves 12 and 22 and rollers 14 can cooperatively operate. In detail, the rubbing sleeves 12 rotate as the shaft 11 rotates. And in turn, the rollers 14 at both sides move laterally toward each other or away from each other in a cycle, thereby rubbing the back of a person. Further, the rubbing sleeves 22 rotate as the shaft 21 rotates. And in turn, the arms 13 move up and down repeatedly as the links 23 move. As a result, the rollers 14 beat the back. Furthermore, the joint 32 rotates as the motor 31 activates. And in turn, the second links 34 at both sides move laterally toward each other or away from each other in a cycle by the linking motion of the first links 33. The pulleys 35 thus cause the rubbing sleeves 12 to move along the shaft 11 and cause the rubbing sleeves 22 to move along the shaft 22 respectively. As such, the rollers 14 at both sides move laterally toward each other or away from each other. As a result, a wide area of the back is massaged.

However, the prior art suffered from a disadvantage. For example, there is no provision of kneading mechanism. Hence, a need has arisen for an improved massage device having all of the above features and an additional kneading feature in order to overcome the inadequacy of the prior art and contribute significantly to the advancement of the art.

SUMMARY OF THE INVENTION

It is therefore an object of the present invention to provide a massage device comprising a motor driven rubbing mechanism comprising two eccentric rubbing sleeves at both ends of a motor shaft, two housings each for enclosing the rubbing sleeve, two upper arms at both sides each having an upper roller, and two lower arms at both sides each having a lower roller; a motor driven beating mechanism comprising two beating sleeves at both ends of a motor shaft, and two links each interconnected the beating sleeve and the housing at the same side; a motor driven angle adjustment mechanism comprising a rotating rod and a linking assembly interconnected the rotating rod and the rubbing mechanism for adjusting an angle of each roller; two kneading mechanisms at both sides each disposed proximate the housing and the lower arm at the same side, each kneading mechanism comprising two spaced plates and a drive source between the plates for activating the lower arms; and a motor driven transmission mechanism comprising a transverse threaded rod, two shrouds threadedly put on both ends of the threaded rod, and two linking boards each interconnected the shroud and the rubbing and beating mechanisms such that the rubbing and beating mechanisms are adapted to move laterally for moving the upper and lower rollers the same direction.

In one aspect of the present invention, there are further provided two sensing mechanisms at both sides each comprising a sensor proximate the housing, a stop member at rear of the upper arm, and a lower spring connected to the housing and the upper arm.

The above and other objects, features and advantages of the present invention will become apparent from the following detailed description taken with the accompanying drawings.

DETAILED DESCRIPTION OF THE INVENTION

Figure 1:
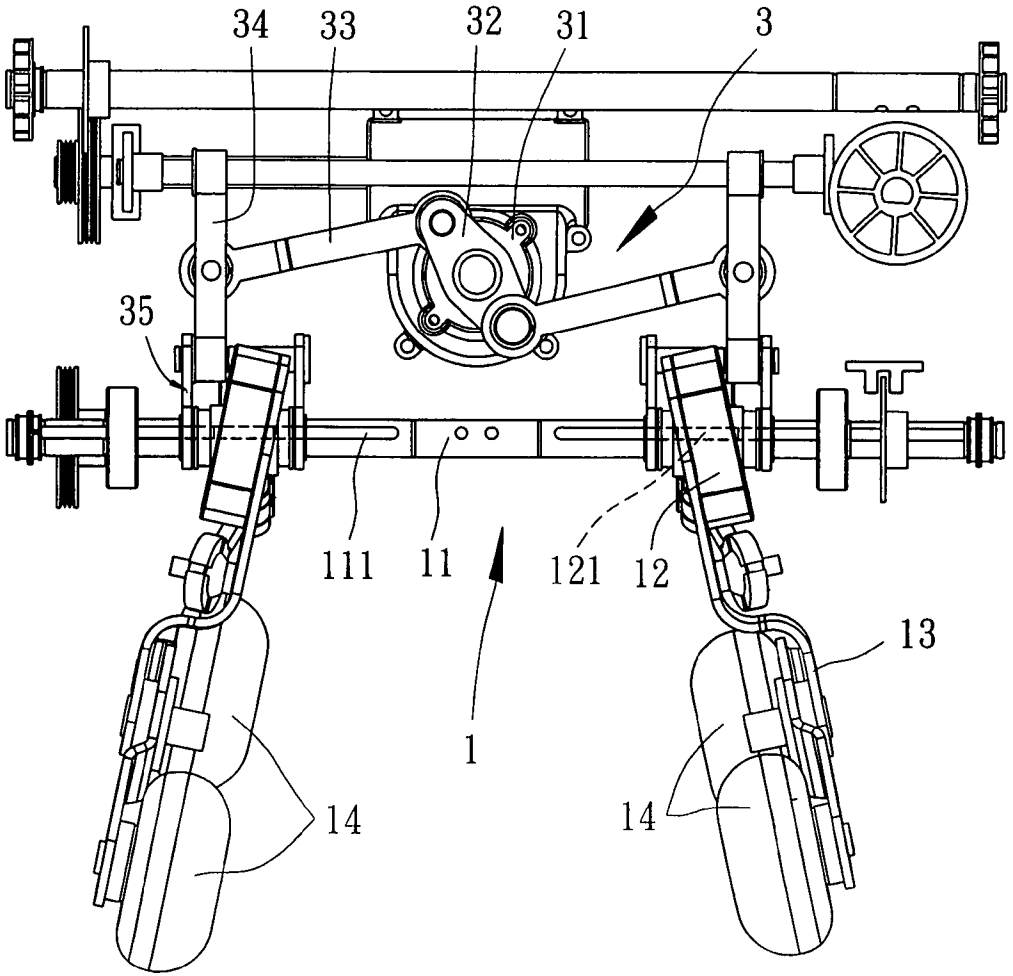
FIG. 1 PRIOR ART
FIG. 1 is a top plan view of a conventional massage device.
Figure 2:
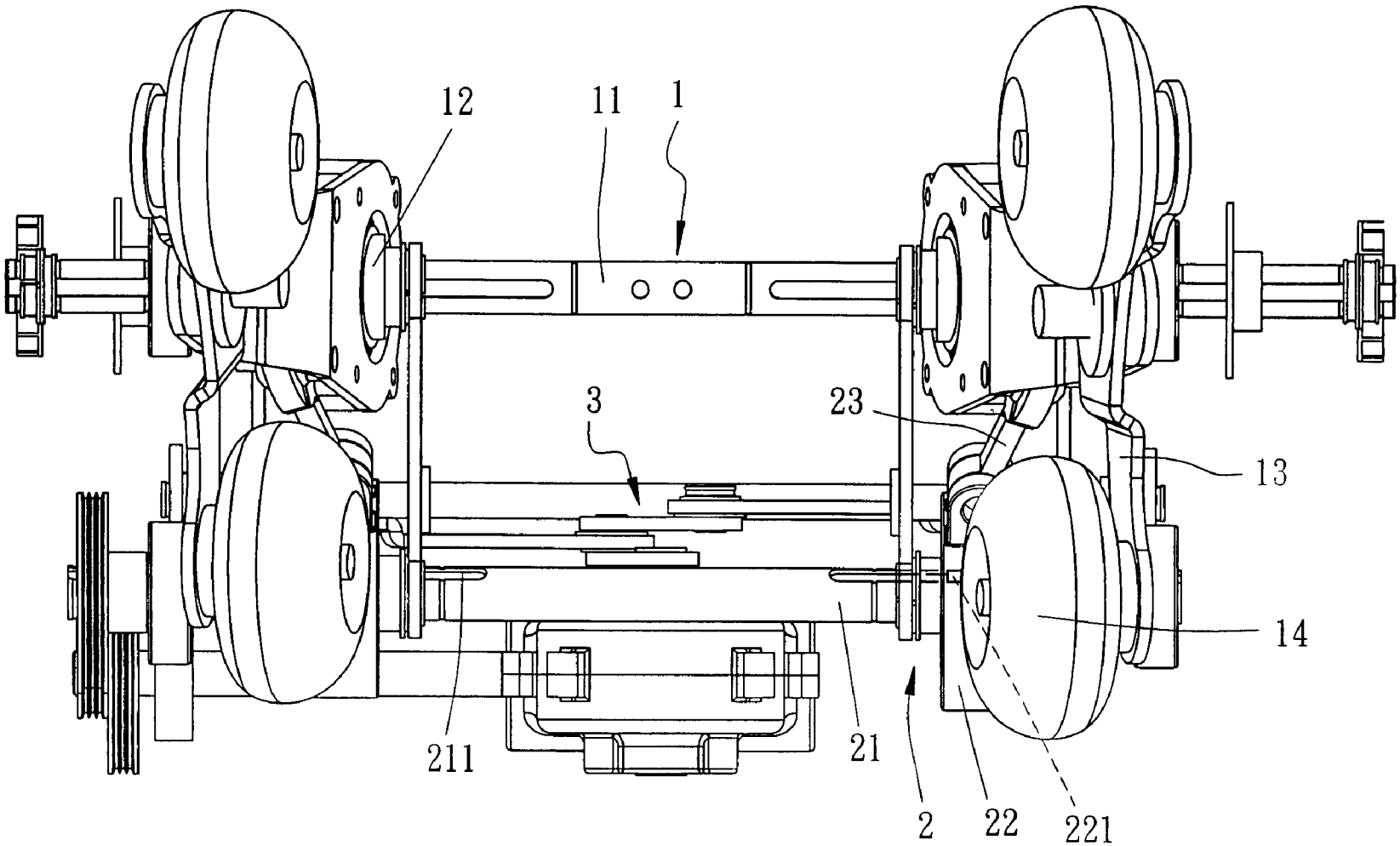
FIG. 2 PRIOR ART
FIG. 2 is a front view of the massage device in FIG. 1.
Figure 3:
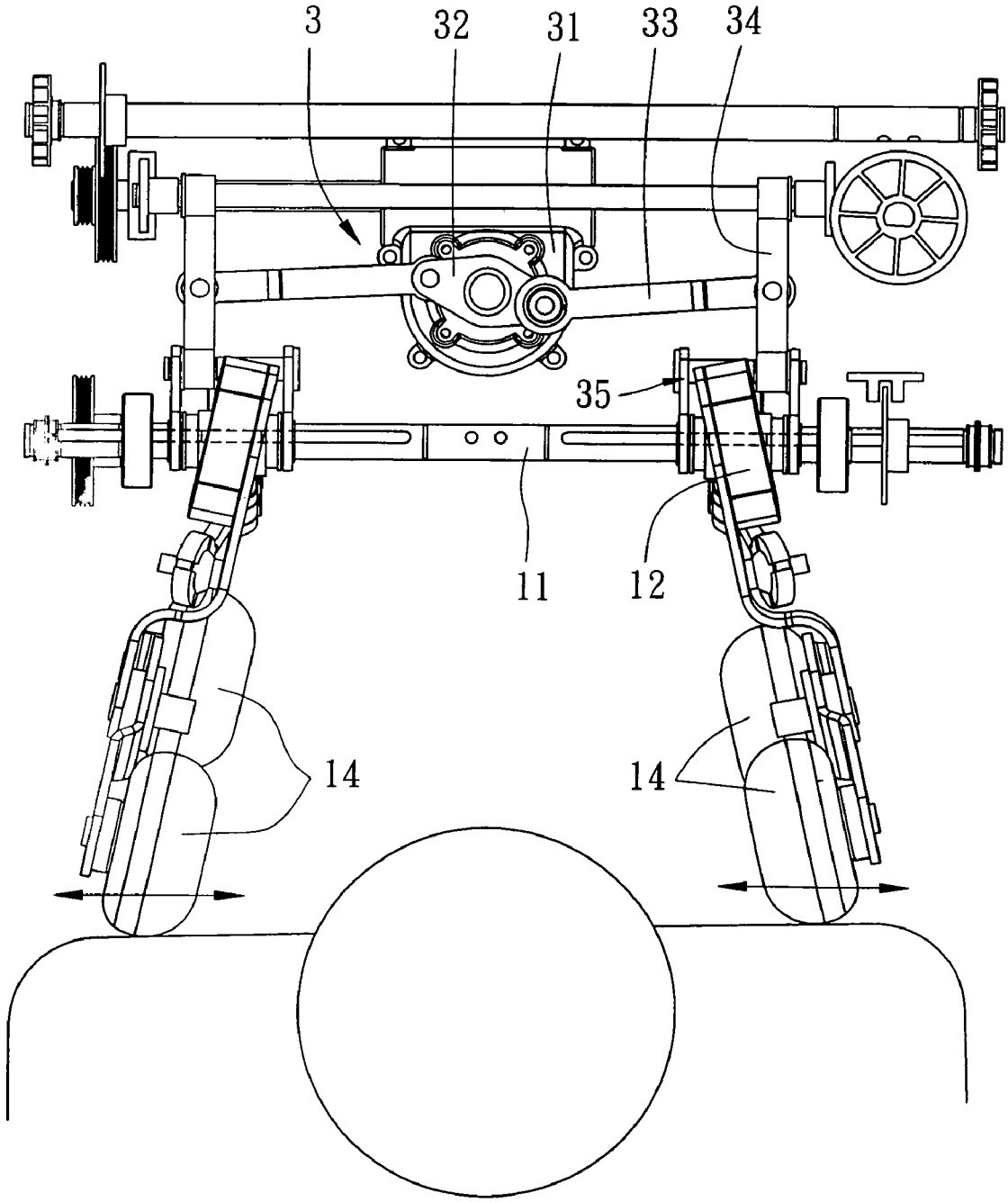
F I G . 3 PRIOR ART
FIG. 3 is a view similar to FIG. 1 for showing a massage operation of the massage device.

Referring to FIGS. 4 to 7, there is shown a massage device constructed in accordance with a preferred embodiment of the invention. The massage device comprises an angle adjustment mechanism 4 comprising a motor 41, a pulley 42 at one side driven by the motor 41, a transverse rotating rod 43 having one end rotatably connected to the pulley 42, two gears 44 in which one is disposed at a position proximate the pulley 42 and the other is disposed at the other end of the rod 43, two side toothed plates 45 each in gear connection with the gear 44, a support 46 fixedly connected to the toothed plates 45, and a shaft 47 pivotably connected to the support 46 such that the support 46 is adapted to pivot a predetermined angle for adjustment purpose as detailed later.

The massage device further comprises a rubbing mechanism 5 comprising a motor 51, a shaft 52 driven by the motor 51, two eccentric rubbing sleeves 53 at both ends of the shaft 52, two housings 54 each for enclosing the rubbing sleeve 53, two upper arms 55 at both sides each having an upper roller 56, and two lower arms 57 at both sides each having a lower roller 58; a beating mechanism 6 comprising a motor 61, a pulley 62 driven by the motor 61, a shaft 63 driven by the pulley 62, two beating sleeves 64 at both ends of the shaft 63, two links 65 each interconnected the beating sleeve 64 and the housing 54 at the same side for activating the rollers 56 and 58 in a beating operation as detailed later.

The massage device further comprises a transmission mechanism 7 proximate the beating mechanism 6. The transmission mechanism 7 comprises a motor 71, a pulley 72 driven by the motor 71, a transverse threaded rod 73, two shrouds 74 threadedly put on both ends of the threaded rod 73, and two linking boards 75 each interconnected the shroud 74 and both the shafts 52 and 63. As such, the rubbing sleeves 53 and the beating sleeves 64 are able to move laterally for moving the rollers 56 and 58 the same direction. The massage device further comprises two kneading mechanisms 8 at both sides each disposed proximate the housing 54 and the lower arm 57 at the same side. The kneading mechanism 8 comprises two spaced plates 81 and 82 disposed substantially vertically, a top spring 83 interconnected the plates 81 and 82, a lower bellows 84 between the plates 81 and 82, and an air pump 85 for inflating the bellows 84; and two sensing mechanisms 9 at both sides each comprising a sensor 91 having a controller (not shown) proximate the housing 54, a top stop member 92 at rear of the upper arm 55, and a lower spring 93 connected to the housing 54 and the upper arm 55.

Figure 4:
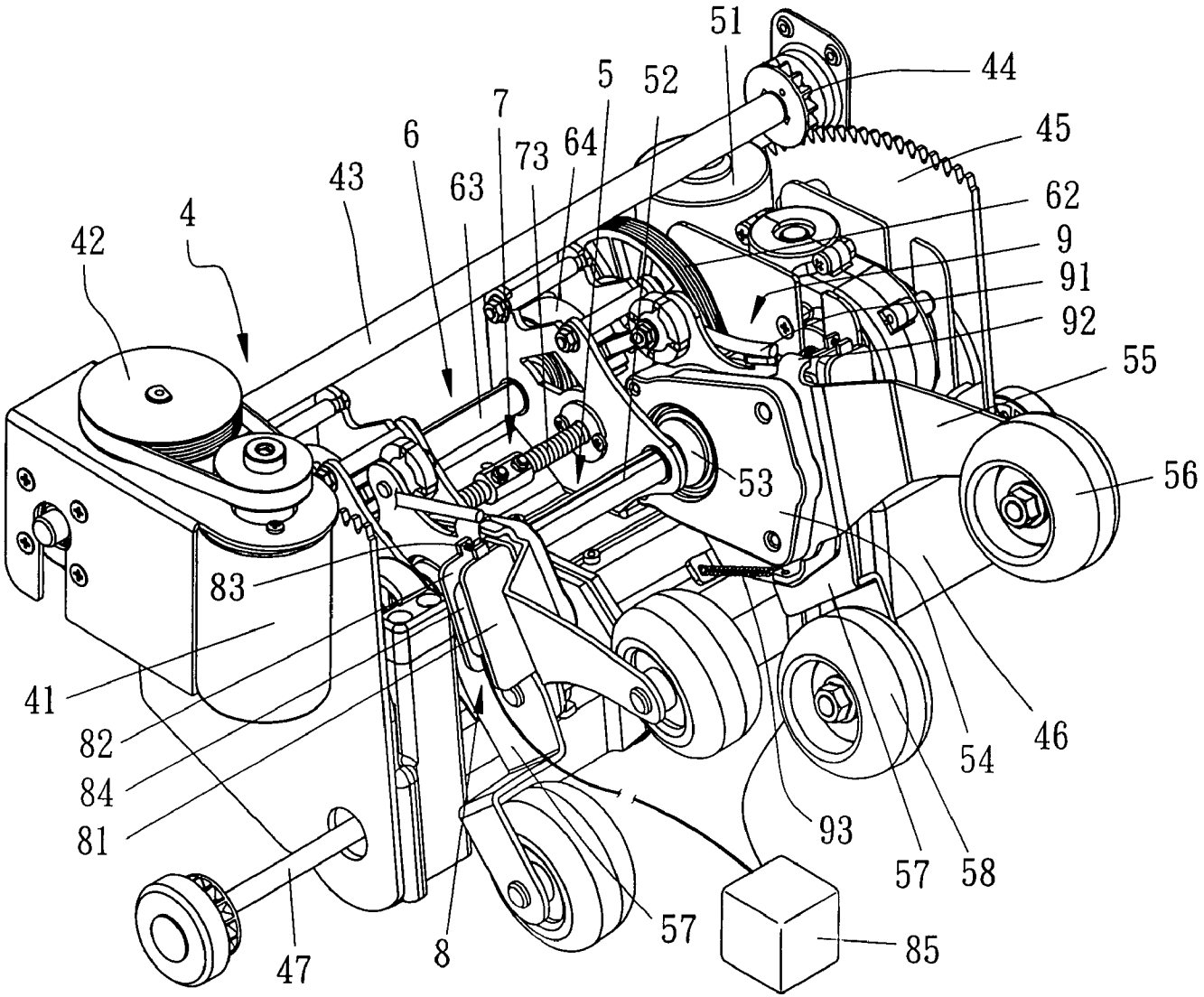
FIG. 4 is a perspective view of a preferred embodiment of massage device according to the invention.
Figure 5:
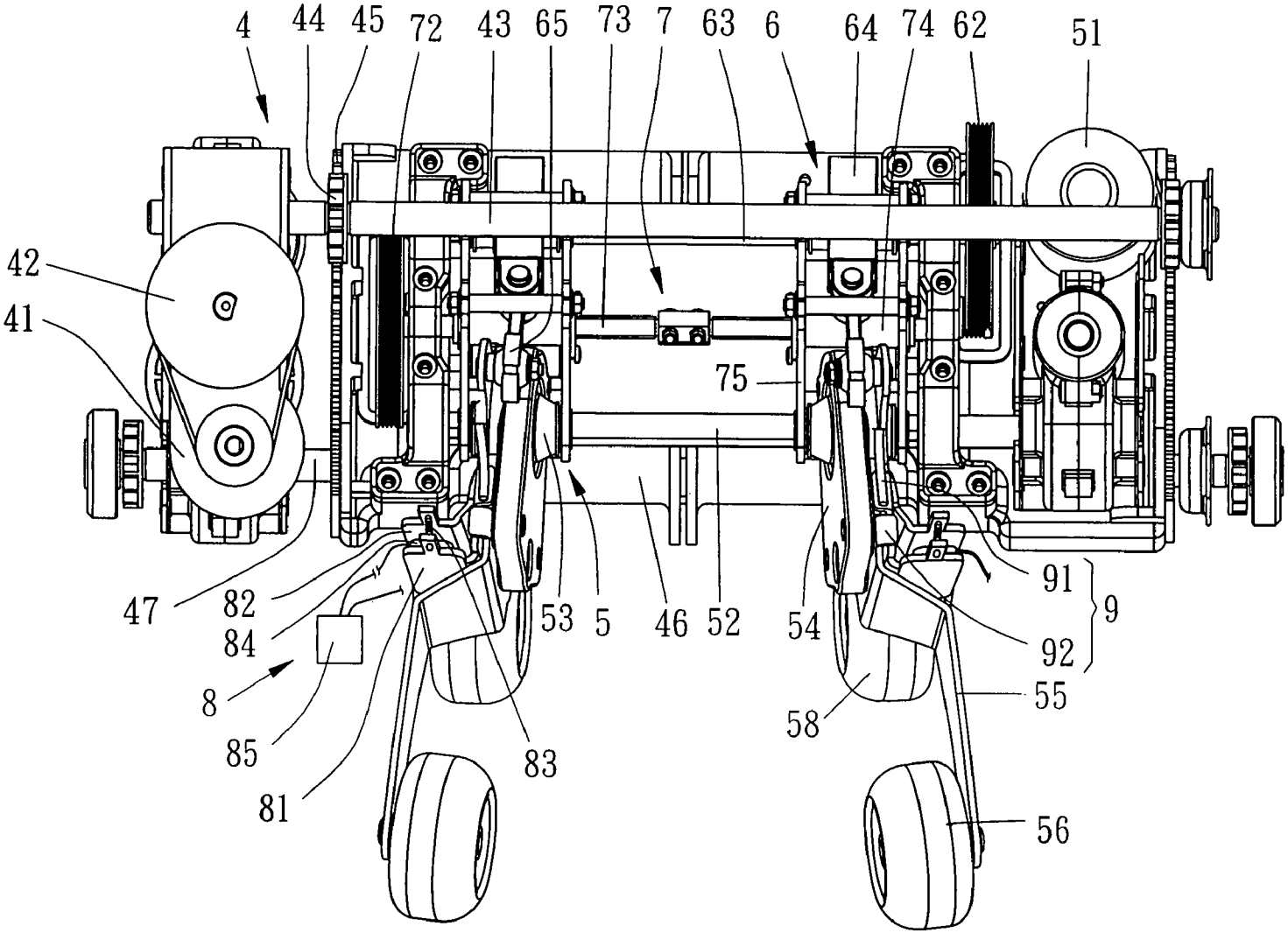
FIG. 5 is a top plan view of the massage device in FIG. 4.
Figure 6:
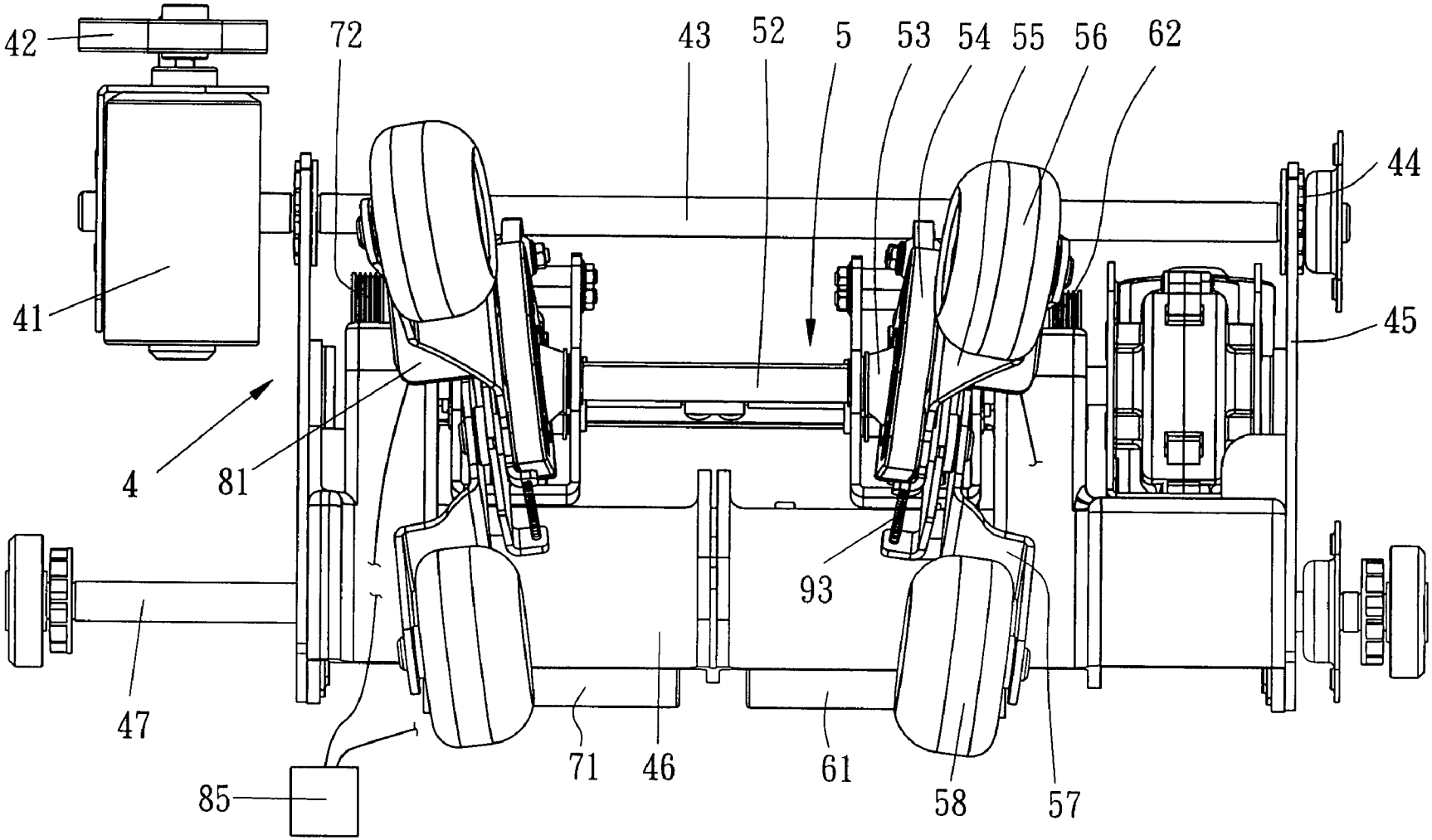
FIG. 6 is a front view of the massage device in FIG. 4.
Figure 7:
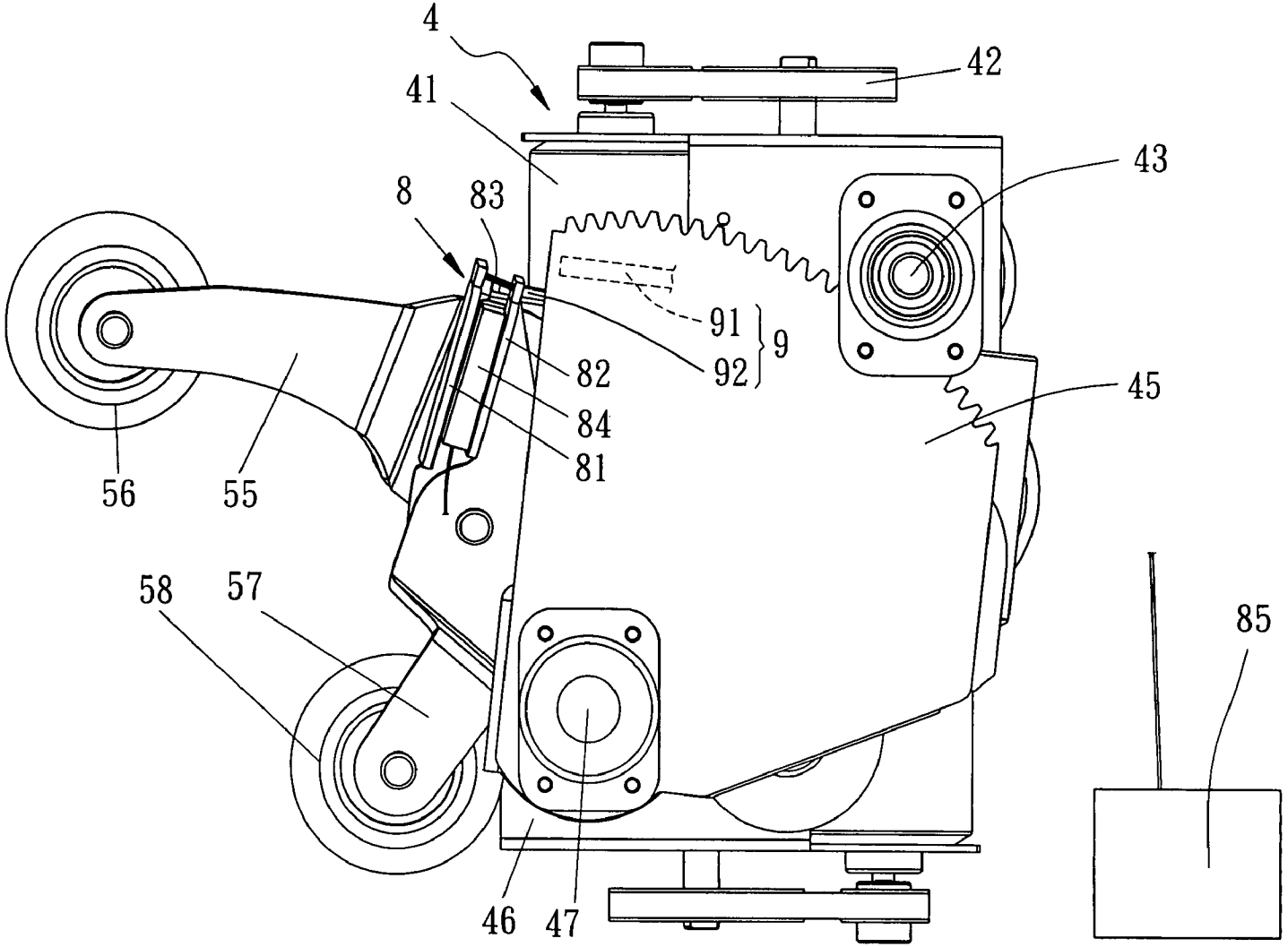
FIG. 7 is a side view of the massage device in FIG. 4.
Figure 8:
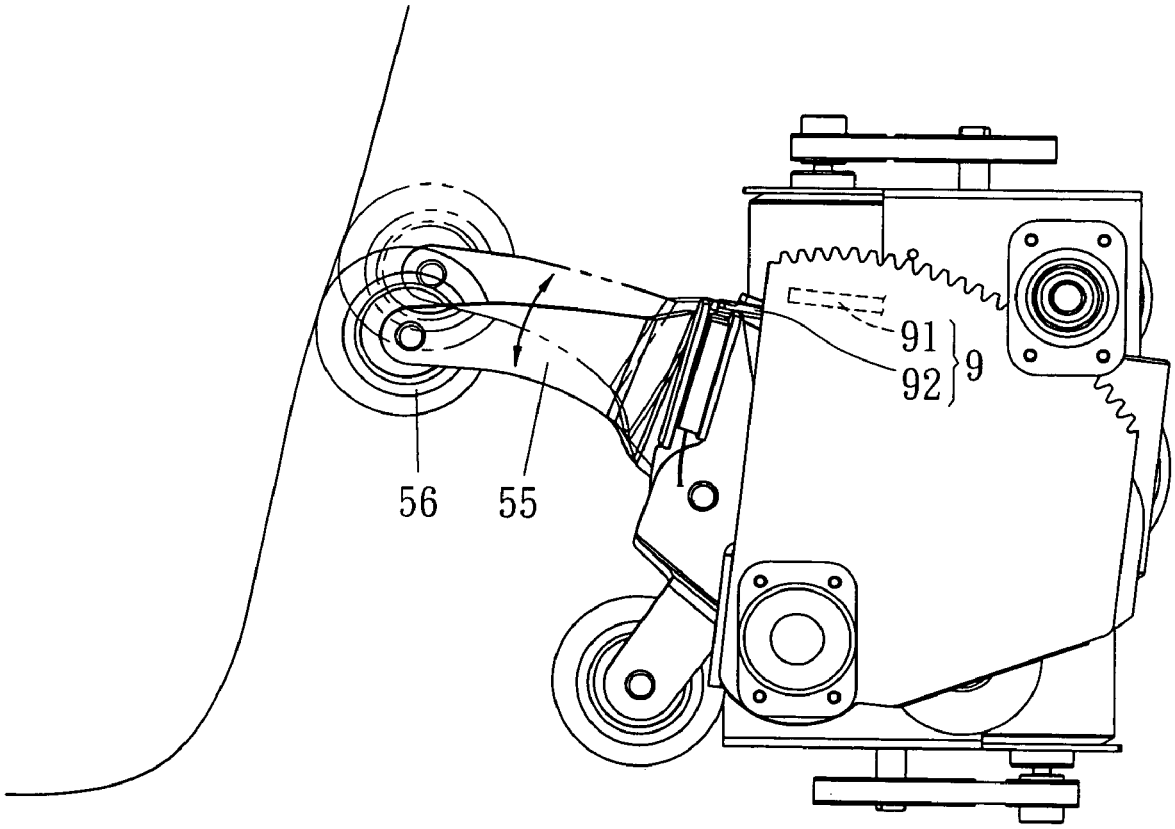
FIG. 8 is an environmental view showing the sensing mechanism being activated to cause the rollers to sense contour of the back of a person.

Referring to FIG. 8 in conjunction with FIG. 4, prior to massage the sensing mechanisms 9 are enabled to sense contour of the back of a person. That is, the rotating upper rollers 56 move upward along the back so as to cause the stop members 92 to shield the sensors 91. Signals sensed by the sensors 91 are sent to the controllers. Next, the upper arms 55 are retracted back by the compression of the springs 83 fixedly connected to the housings 54. The above procedure can be repeated until contour of the back has been completely sensed by the sensing mechanisms 9. As such, the mechanisms of the massage device can be precisely controlled by the controllers.

Referring to FIG. 8 in conjunction with FIG. 4, for rubbing the body the motor 51 is activated to rotate the shaft 52. The rollers 56 and 58 in front of the housings 54 rotate and move cyclically due to the eccentric configuration of the rubbing sleeves 53. For beating the body the motor 61 is activated to drive the pulley 62 for rotating the shaft 63. The upper and lower rollers 56 and 58 thus beat the body due to the eccentric configuration of the beating sleeves 64 and two linking mechanisms each consisting of the link 65, the housing 54, and the upper and lower arms 55 and 57. For adjusting massage position the motor 71 is activated to drive the pulley 72 for rotating the shaft 63. The shrouds 74 threadedly put on both ends of the threaded rod 73 are activated to laterally move the rubbing sleeves 53, the beating sleeves 64, and the upper and lower rollers 56 and 58 toward each other or away from each other in a cycle, thereby adjusting massage position.

Figure 9:
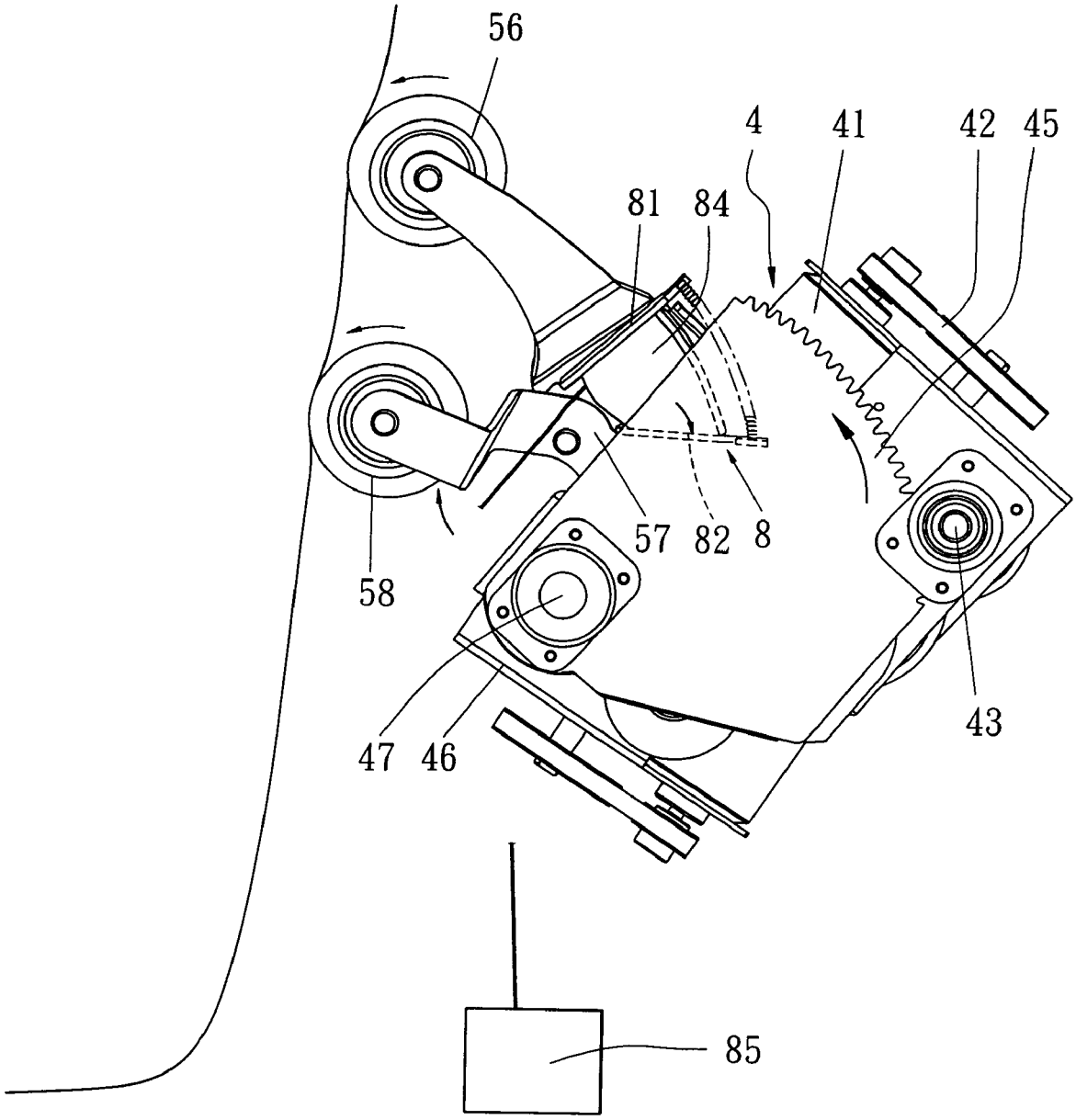
FIG. 9 is a view similar to FIG. 8 for showing a pressing operation of the massage device in FIG. 4.

Referring to FIG. 9 in conjunction with FIG. 4, for pressing the body the kneading mechanism 8 is required to cooperate with the angle adjustment mechanism 4. The air pump 85 is activated to inflate each bellows 84 to urge against the fixed housings 54 and the plates 81 and 82. The lower arms 57 move as one ends of the plates 82 being urged. As such, the lower rollers 58 at the other ends of the lower arms 57 pivot upward until a desired position is reached. Next, the motor 41 is activated to drive the pulley 42 for rotating the shaft 43. Each gear 44 thus rotates relative to and along a top of the toothed plate 45. As such, the support 46 pivots about the shaft 47 for adjusting angles of associated components. As an end, the upper and lower rollers 56 and 58 project forward to press the body.

Figure 10:
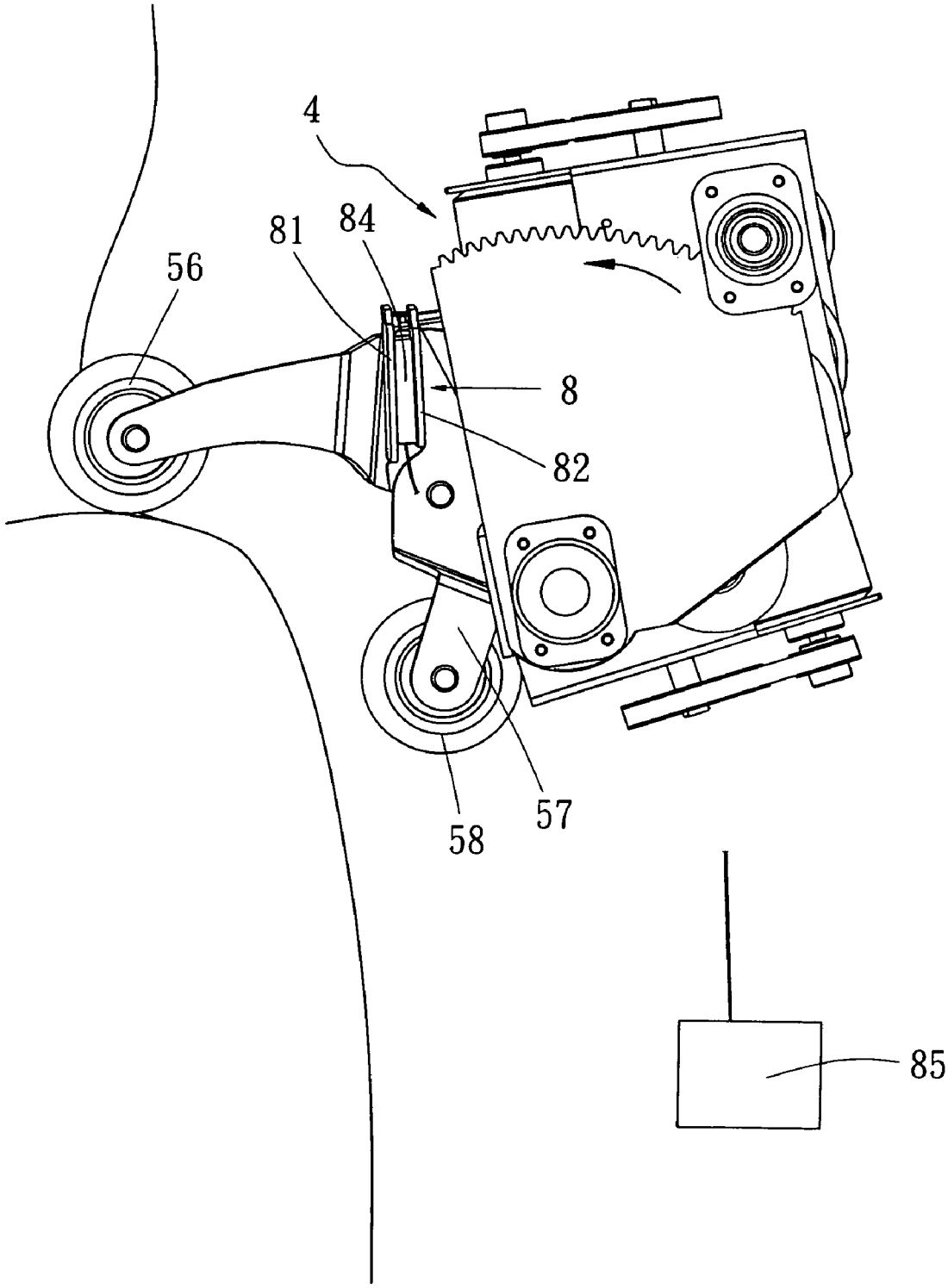
FIGS. 10 and 11 are views similar to FIG. 9 for showing a kneading operation of the massage device in FIG. 4.
Figure 11:
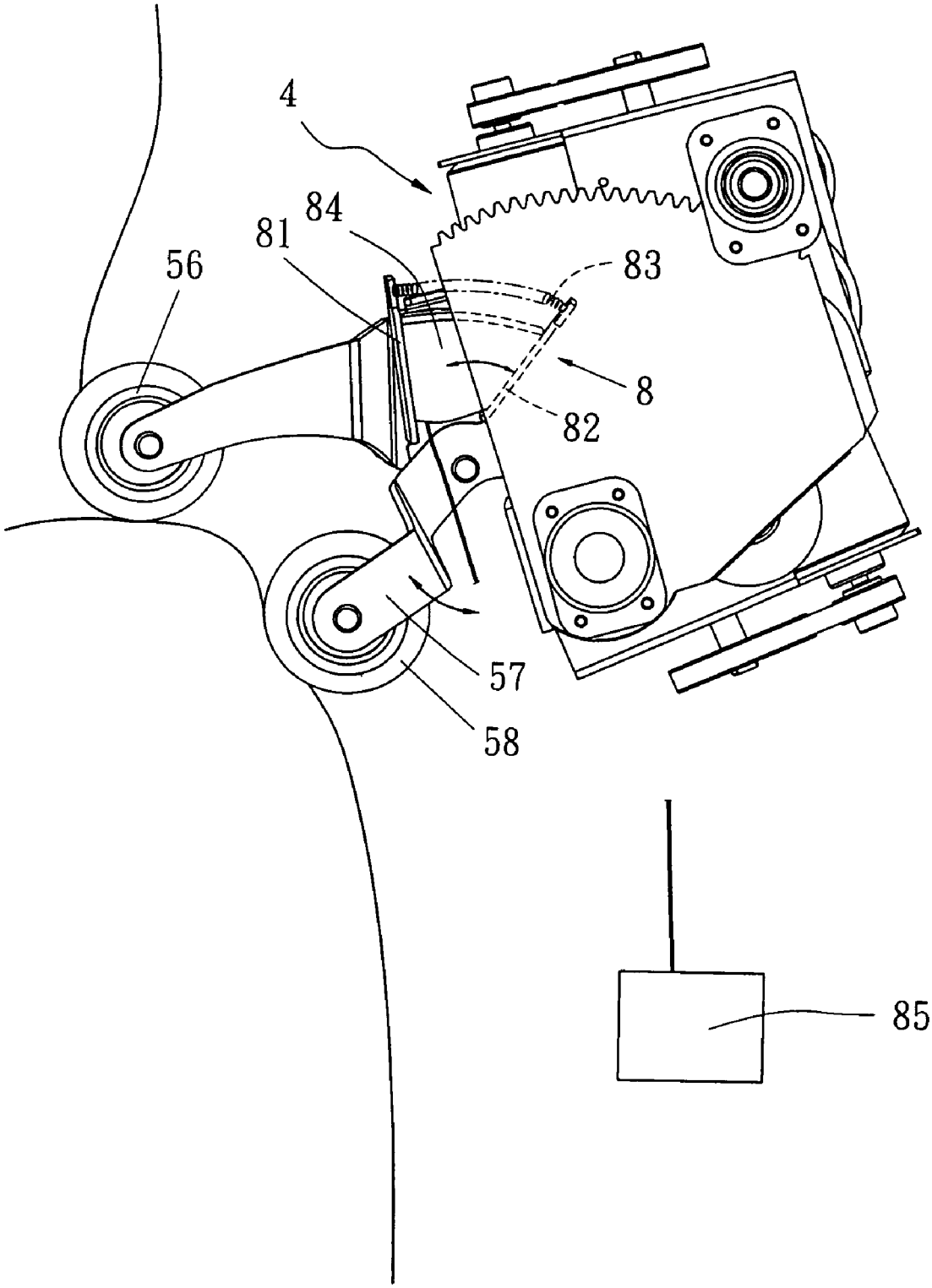

Referring to FIGS. 10 and 11 in conjunction with FIG. 4, in a case of the massage device disposed to massage the shoulder the angle adjustment mechanism 4 may be enabled to adjust angles of the upper and lower rollers 56 and 58 so as to place the upper rollers 56 on the shoulder. Next, the air pump 85 is activated to inflate each bellows 84 to urge against the fixed housings 54 and the plates 81 and 82. The lower arms 57 thus pivot to cause the lower rollers 58 to move upward to knead the shoulder. Next, release air in each bellows 84 for retracting the plates 82 back to its nonoperating position due to the compression of the springs 83. The lower arms 57 move to lower the lower rollers 58 for halting the kneading. Above procedure can be performed continuously for completely massaging the shoulder.

While the invention herein disclosed has been described by means of specific embodiments, numerous modifications and variations could be made thereto by those skilled in the art without departing from the scope and spirit of the invention set forth in the claims.

What is claimed is:

1. A massage device comprising:

a motor driven rubbing mechanism comprising an eccentric rubbing sleeve at each end of a motor shaft, two housing each for enclosing the rubbing sleeve, an upper arm at each side, each having an upper roller, and a lower arm at each side, each having a lower roller;

a motor driven beating mechanism comprising a beating sleeve at each end of a motor shaft, and two links each interconnecting the beating sleeve and the housing at the same side;

a motor driven angle adjustment mechanism comprising a rotating rod and a linking assembly interconnecting the rotating rod and the rubbing mechanism for adjusting an angle of each roller; and a kneading mechanisms at each side, each disposed proximate the housing and the lower arm at the same side, each kneading mechanism comprising two spaced plates and a drive source between the plates for activating the lower arms;

wherein the linking assembly comprises a gear at each end of the rotating rod, two side toothed plates each in gear connection with the gear, a support fixedly connected to the toothed plates with the rubbing mechanism disposed thereon, and a shaft pivotably connected to the support.

2. The massage device of claim 1, wherein each kneading mechanism further comprises a spring interconnecting the plates.

3. The massage device of claim 1, further comprising a sensing mechanisms at each side, each comprising a sensor proximate the housing and a stop member at rear of the upper arm.

4. The massage device of claim 3, wherein each sensing mechanism further comprises a lower spring connected to the housing and the upper arm.

5. A massage device comprising:

a motor driven rubbing mechanism comprising an eccentric rubbing sleeve at each end of a motor shaft, two housing each for enclosing the rubbing sleeve, an upper arm at each side, each having an upper roller, and a lower arm at each side, each having a lower roller;

a motor driven beating mechanism comprising a beating sleeve at each end of a motor shaft, and two links each interconnecting the beating sleeve and the housing at the same side;

a motor driven angle adjustment mechanism comprising a rotating rod and a linking assembly interconnecting the rotating rod and the rubbing mechanism for adjusting an angle of each roller; and a kneading mechanisms at each side, each disposed proximate the housing and the lower arm at the same side, each kneading mechanism comprising two spaced plates and a drive source between the plates for activating the lower arms;

the massage device further comprising an air pump, and wherein the drive source is a bellows adapted to be inflated by the air pump.

6. A massage device comprising:

a motor driven rubbing mechanism comprising an eccentric rubbing sleeve at each end of a motor shaft, two housing each for enclosing the rubbing sleeve, an upper arm at each side, each having an upper roller, and a lower arm at each side, each having a lower roller;

a motor driven beating mechanism comprising a beating sleeve at each end of a motor shaft, and two links each interconnecting the beating sleeve and the housing at the same side;

a motor driven angle adjustment mechanism comprising a rotating rod and a linking assembly interconnecting the rotating rod and the rubbing mechanism for adjusting an angle of each roller; and a kneading mechanisms at each side, each disposed proximate the housing and the lower arm at the same side, each kneading mechanism comprising two spaced plates and a drive source between the plates for activating the lower arms;

the massage device further comprising a motor driven transmission mechanism comprising a transverse threaded rod, a shroud threadedly put on each end of the threaded rod, and two linking boards each interconnecting the shroud and the rubbing and beating mechanisms such that the rubbing and beating mechanisms are adapted to move laterally for moving the upper and lower rollers the same.

* * * * *